US006914202B2

(12) United States Patent
Sugimoto et al.

(10) Patent No.: US 6,914,202 B2
(45) Date of Patent: Jul. 5, 2005

(54) TWO-STEP SWITCH DEVICE

(75) Inventors: Satoshi Sugimoto, Aichi (JP); Makoto Kobayashi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/811,289

(22) Filed: Mar. 25, 2004

(65) Prior Publication Data

US 2004/0188235 A1 Sep. 30, 2004

(30) Foreign Application Priority Data

Mar. 28, 2003 (JP) ..... 2003-091131

(51) Int. Cl.[7] ..... H01H 9/00
(52) U.S. Cl. ..... 200/1 B
(58) Field of Search ..... 200/1 B, 5 R, 200/4, 17 R, 18, 339, 517, 553

(56) References Cited

U.S. PATENT DOCUMENTS 5,115,108 A 5/1992 Ogawa et al.
5,719,361 A * 2/1998 Lee ..... 200/1 B
5,753,874 A * 5/1998 Kossakowski ..... 200/1 B
5,834,716 A * 11/1998 Lee ..... 200/1 B
6,274,826 B1 8/2001 Serizawa et al.
6,437,259 B1 * 8/2002 Geppert et al. ..... 200/1 B
6,693,246 B1 * 2/2004 Rudolph et al. ..... 200/1 B
6,737,592 B1 * 5/2004 Hoang et al. ..... 200/1 B
6,750,406 B2 * 6/2004 Komatsu et al. ..... 200/1 B

FOREIGN PATENT DOCUMENTS

JP 2000-11807 A 1/2000
WO 0 884 744 A2 12/1998

* cited by examiner

*Primary Examiner*—Michael A. Friedhofer
(74) *Attorney, Agent, or Firm*—Crompton, Seager & Tufte, LLC

(57) ABSTRACT

A switch device having a reduced number of components while reducing the difference between the forces required to operate switches in different directions. The switch device includes a first switch, a second switch, a button, and a pusher. Inclination of the button in the first direction to a first operation position solely activates the first switch. Further inclination of the button in the first direction to a second operation position activates the second switch in addition to the first switch. Inclination of the button in the second direction to a third operation position solely activates the second switch. Further inclination of the button in the second direction to a fourth operation position activates the first switch in addition to the second switch.

11 Claims, 5 Drawing Sheets

| Contact Portion | | Control Unit 53 |
|---|---|---|
| 1st Switch 15 | 2nd Switch 16 | |
| ON | OFF | Manual Open |
| ON | (ON After 1st Switch 15 Goes ON) | Automatic Close |
| OFF | ON | Manual Close |
| (ON After 2nd Switch 16 Goes ON) | ON | Automatic Close |

TWO-STEP SWITCH DEVICE

BACKGROUND OF THE INVENTION

The present invention relates to a switch device, and more particularly, to a two-step switch device having a button that is movable to two steps when the button is moved in one direction and to a vehicle window driving apparatus that uses such a two-step switch device.

A window switch device arranged in the passenger compartment of a vehicle has a seesaw type button or push-pull type button that is inclined to open or close a window. As one type of such a switch device, Japanese Laid-open Patent Publication No. 2000-11807 describes a two-step switch device.

The two-step switch device has a first switch and a second switch. The first switch includes a manual down switch and a manual up switch. The second switch includes an automatic down switch and an automatic up switch.

Force is applied to the button of the two-step switch in two steps in an upward direction and two steps in a downward direction.

More specifically, when the button is inclined in the downward direction (the direction for opening the window) to a manual position, the inclination of the button activates only the manual down switch of the first switch. In this case, the window moves in the opening direction only when the manual down switch is activated, or when the button is inclined in the downward direction to the manual position. Further, when the button is inclined further from the manual position to an automatic position, the automatic down switch of the second switch is also activated in addition to the manual down switch. This moves the window to the lowermost position to open the window even if the button is returned from the automatic position to the original position and each switch is inactivated.

When the button is inclined in the upward direction (the direction for closing the window) to the manual position, the inclination of the button activates only the manual up switch of the first switch. In this case, the window moves in the closing direction only when the manual up switch is activated, or when the button is inclined in the upward direction to a manual position. Further, when the button is inclined further from the manual position to an automatic position, the automatic up switch of the second switch is also activated in addition to the manual up switch. This moves the window to the uppermost position to open the window even if the button is returned from the automatic position to the original position and each switch is inactivated.

In the above two-step switch device, each switch includes a resiliently deformable dome. The dome is elastically deformed to activate the associated switch. In the two-step switch device, the elastic deformation of each switch produces an appropriate positioning feel that is perceived at the manual and automatic positions.

The conventional two-step switch requires four switches, which are the manual down switch, the manual up switch, the automatic down switch, and the automatic up switch. This is to equalize the force required to incline the button in the downward and upward directions. To achieve this object, the employment of four switches is necessary in the prior art.

To simplify the internal structure and save costs, the number of components must be reduced. Thus, there is a demand for decreasing the number of switches.

SUMMARY OF THE INVENTION

It is an object of the present invention to provide a switch device and a vehicle power window drive apparatus that reduces the number of components while reducing the differences between the forces applied in each direction to operate the switches.

To achieve the above object, the present invention provides a switch device operable in two steps. The switch device includes a first switch, a second switch, and a button, inclinable in a first direction and a second direction, for activating the first and/or second switch. The button is inclinable to a first operation position and a second operation position when inclined in the first direction and is inclinable to a third operation position and a fourth operation position when inclined in the second direction. A pusher is arranged between the button and the first and second switches. The pusher is movable when the button is pushed. Inclination of the button in the first direction to the first operation position moves the pusher to solely activate the first switch. Further inclination of the button in the first direction to the second operation position moves the pusher to activate the second switch in addition to the first switch. Inclination of the button in the second direction to the third operation position solely moves the pusher to activate the second switch. Further inclination of the button in the second direction to the fourth operation position moves the pusher to activate the first switch in addition to the second switch.

A further aspect of the present invention is a switch device operable in two steps. The switch device includes a first switch and a second switch. The first switch includes a first fixed contact and a first movable contact associated with the first fixed contact. The second switch includes a second fixed contact and a second movable contact associated with the second fixed contact. A pusher is movably arranged on the first and second movable contacts. The pusher includes a first switch operator, arranged in association with the first movable contact, for activating the first switch and a second switch operator, arranged in association with the second movable contact, for activating the second switch. The switch device also has a button including a first pushing portion for pushing a first portion located at a top of the pusher in correspondence with the first switch and a second pushing portion for pushing a second portion located at the top of the pusher in correspondence with the second switch. The button is inclinable in a first direction to push the pusher with the first pushing portion and is inclinable in a second direction to push the pusher with the second pushing portion. The button is inclinable to a first operation position and a second operation position when inclined in the first direction and is inclinable to a third operation position and a fourth operation position when inclined in the second direction. Inclination of the button in the first direction to the first operation position moves the pusher and solely activates the first switch with the first switch operator. Further inclination of the button in the first direction to the second operation position further moves the pusher and activates the second switch with the second switch operator in addition to the first switch. Inclination of the button in the second direction to the third operation position moves the pusher and solely activates the second switch with the second switch operator. Further inclination of the button in the second direction to the fourth operation position further moves the pusher and activates the first switch with the first switch operator in addition to the second switch.

A further aspect of the present invention is a switch device operable in two steps. The switch device includes a first switch, a second switch, and a pusher movably arranged on the first and second switches. The pusher includes a first switch operator, arranged in association with the first switch, for activating the first switch, a second switch operator, arranged in association with the second switch, for activating the second switch, and a first extension and a second extension respectively arranged opposite the first and second switch operators. A switch body accommodates the pusher. The switch body includes a first receiving portion for contacting the first extension of the pusher and a second receiving portion for contacting the second extension of the pusher. A button is supported-by the switch body in an inclinable manner. The button includes a first pushing portion for pushing a first portion located at a top of the pusher in correspondence with the first switch and a second pushing portion for pushing a second portion located at the top of the pusher in correspondence with the second switch. The button is inclinable in a first direction to push the pusher with the first pushing portion and is inclinable in a second direction to push the pusher with the second pushing portion. The button is inclinable to a first operation position and a second operation position when inclined in the first direction and is inclinable to a third operation position and a fourth operation position when inclined in the second direction. Inclination of the button in the first direction to the first operation position moves the pusher and solely activates the first switch with the first switch operator. Further inclination of the button in the first direction to the second operation position further moves the pusher about a position of contact between the first extension and the first receiving portion to activate the second switch with the second switch operator in addition to the first switch. Inclination of the button in the second direction to the third operation position moves the pusher and solely activates the second switch with the second switch operator. Further inclination of the button in the second direction to the fourth operation position further moves the pusher about a position of contact between the second extension and the second receiving portion to activate the first switch with the first switch operator in addition to the second switch.

A further aspect of the present invention is a vehicle window drive apparatus for opening and closing a vehicle window. The vehicle window drive apparatus includes a switch device operated to open and close the vehicle window. The switch device includes a first switch and a second switch. The first switch includes a first fixed contact and a first movable contact associated with the first fixed contact. The second switch includes a second fixed contact and a second movable contact associated with the second fixed contact. A pusher is movably arranged on the first and second movable contacts. The pusher includes a first switch operator, arranged in association with the first movable contact, for activating the first switch and a second switch operator, arranged in association with the second movable contact, for activating the second switch. A button includes a first pushing portion for pushing a first portion located at a top of the pusher in correspondence with the first switch and a second pushing portion for pushing a second portion located at the top of the pusher in correspondence with the second switch. The button is inclinable in a first direction to push the pusher with the first pushing portion and is inclinable in a second direction to push the pusher with the second pushing portion. The button is inclinable to a first operation position and a second operation position when inclined in the first direction and is inclinable to a third operation position and a fourth operation position when inclined in the second direction. Inclination of the button in the first direction to the first operation position moves the pusher and solely activates the first switch with the first switch operator to keep the window moving in an opening direction as long as the first switch remains activated. Further inclination of the button in the first direction to the second operation position further moves the pusher and activates the second switch with the second switch operator in addition to the first switch to completely open the window. Inclination of the button in the second direction to the third operation position moves the pusher and solely activates the second switch with the second switch operator to keep the window moving in a closing direction as long as the second switch remains activated. Further inclination of the button in the second direction to the fourth operation position further moves the pusher and activates the first switch with the first switch operator in addition to the second switch to completely close the window.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
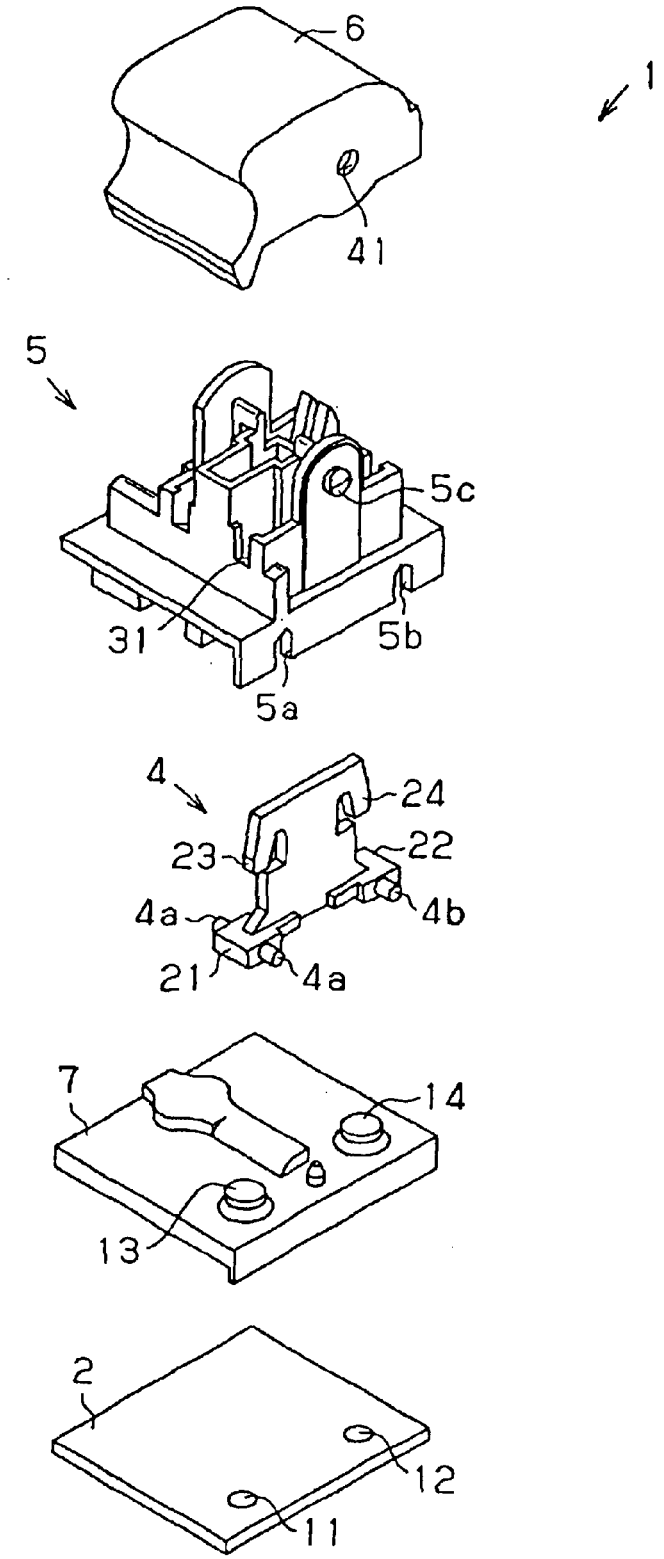
FIG. 1 is an exploded perspective view showing the structure of a two-step switch device according to a preferred embodiment of the present invention.

In the drawings, like numerals are used for like elements throughout.

A two-step switch device 1 used for a vehicle window drive apparatus 51 according to a preferred embodiment of the present invention will now be described with reference to FIGS. 1 to 7.

Referring to FIG. 1, the two-step switch device (hereinafter simply referred to as a "switch device") includes a contact board 2, a base 7, a pusher 4, a switch body 5, and a button 6.

The contact board 2 is a printed circuit board (PCB) formed from, for example, a glass epoxy resin. A first fixed contact 11 and a second fixed contact 12 are arranged on a surface of the contact board 2 (the upper surface as viewed in FIG. 1). The two fixed contacts 11 and 12 are separated from each other by a predetermined distance.

Figure 3:
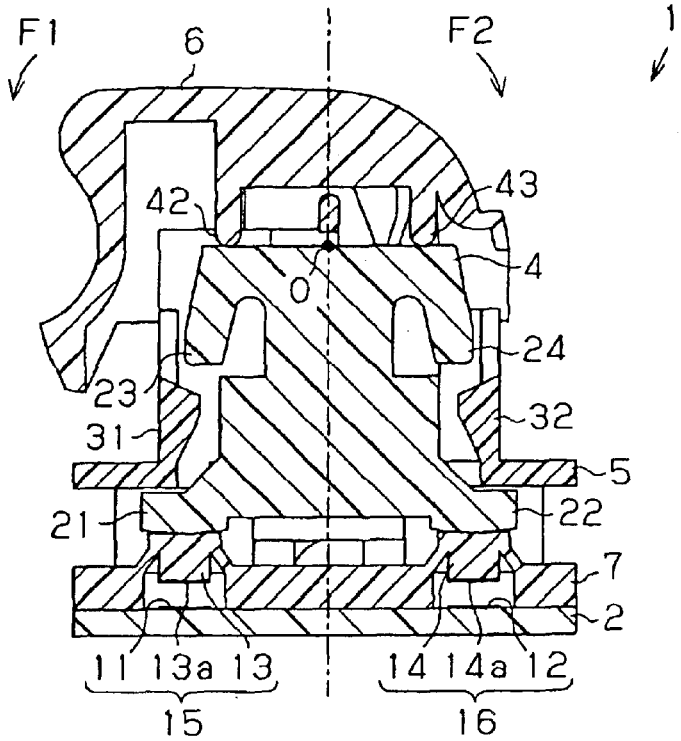
FIG. 3 is a cross-sectional view taken along line 3—3 in FIG. 2.

The base 7 is formed from a resiliently deformable soft resin, such as silicone rubber, and arranged on the contact board 2. A first dome 13 is formed integrally with the base 7 at a position corresponding to the first fixed contact 11. A second dome 14 is formed integrally with the base 7 at a position corresponding to the second fixed contact 12. Referring to FIGS. 3 to 5, in each of the first and second domes 13 and 14, the upper surface is convex and the lower surface is concave. A first movable contact 13*a* is formed on the concave surface of the first dome 13. A second movable contact 14*a* is formed on the concave surface of the second dome 14. The movable contacts 13*a* and 14*a* are separated from the associated fixed contacts 11 and 12 when the first and second domes 13 and 14 are not elastically deformed, respectively. Conversely, the movable contacts 13*a* and 14*a* contact the associated fixed contacts 11 and 12 when the first and second domes 13 and 14 are elastically deformed, respectively. The first and second movable contacts 13*a* and 14*a* move away from the fixed contacts 11 and 12 when resiliency causes the first and second domes 13 and 14 to return to their original shapes, respectively. The first fixed contact 11 and the first dome 13 define a first switch 15. The second fixed contact 12 and the second dome 14 define a second switch 16. In the preferred embodiment, the first dome 13 and the second dome 14 substantially have the same shape and size. Thus, the load required to elastically deform the first dome 13 is substantially the same as the load required to elastically deform the second dome 14.

A pusher 4 and a switch body 5 are arranged above the base 7. The button 6 is arranged above the pusher 4 and the switch body 5. The button 6 is supported in an inclinable manner above the switch body 5. The switch body 5 accommodates the pusher 4 in an inclinable manner. The switch body 5 is fixed so that it does not move relative to the contact board 2 and the base 7. Downward inclination of a front portion of the button 6 in a first direction (the direction indicated by arrow F1 in FIGS. 3, 4A, and 4B) inclines a front portion of the pusher 4 in the same downward direction (first direction). Further, downward inclination of a rear portion of the button 6 in a second direction (the direction indicated by arrow F2 in FIGS. 3, 5A, and 5B) inclines a rear portion of the pusher 4 in the same downward direction (second direction).

In a state in which force is not applied to the pusher 4, the pusher 4 extends across the first and second domes 13 and 14. The pusher 4 has a shape that is symmetrical about a centerline, which is shown by the broken lines in FIG. 3. A first switch operator 21 contacting the convex surface of the first dome 13 is formed on the lower left end of the pusher 4, and a second switch operator 22 contacting the convex surface of the second dome 14 is formed on the lower right end of the pusher 4, as viewed in FIGS. 1 to 5B. Inclination of the pusher 4 in the first direction causes the first switch operator 21 to push the first dome 13. This elastically deforms the first dome 13 and causes the first movable contact 13*a* to contact the first fixed contact 11 (activate the first switch 15). Inclination of the pusher 4 in the second direction causes the second switch operator 22 to push the second dome 14. This elastically deforms the second dome 14 and causes the second movable contact 14*a* to contact the second fixed contact 12 (activate the second switch 16). A projection 4*a* projects from the first switch operator 21. A projection 4*b* projects from the second switch operator 22. The projections 4*a* and 4*b* are connected to the switch body 5 in a manner enabling inclination of the pusher 4.

A first extension (first contact portion) 23 extends downward from the upper front side of the pusher 4. A second extension (second contact portion) 24 extends downward from the upper rear side of the pusher 4. When the pusher 4 is inclined in the first direction to activate the first switch 15, the distal end of the first extension 23 abuts against part of the switch body 5 (first receiving portion 31). When the pusher 4 is inclined in the second direction to activate the second switch 16, the distal end of the second extension 24 abuts against part of the switch body 5 (second receiving portion 32).

Figure 2:
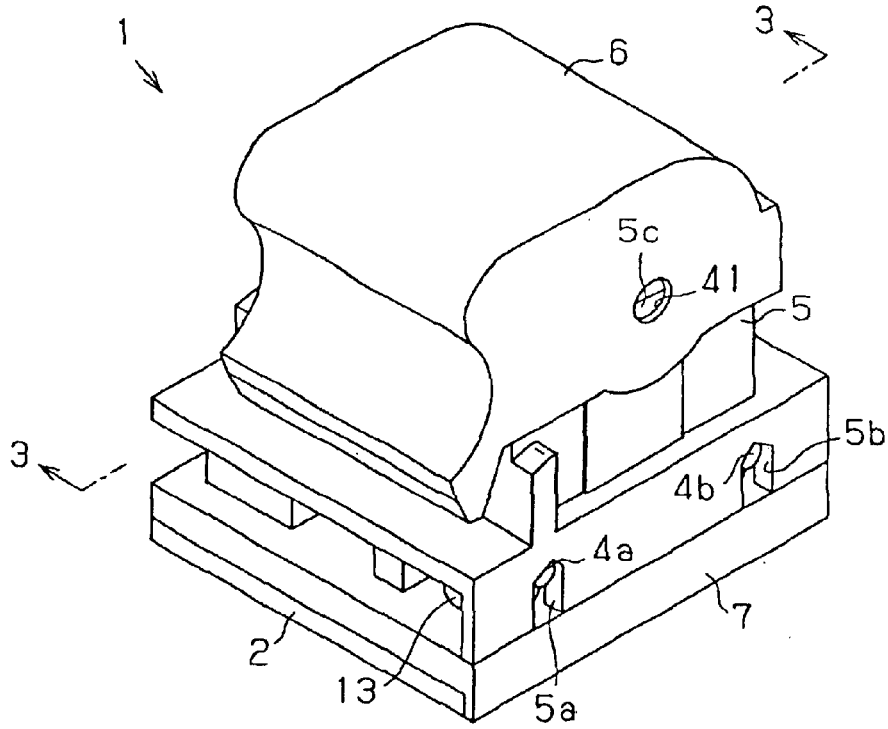
FIG. 2 is a perspective view showing the two-step switch device of FIG. 1.
Figure 4A:
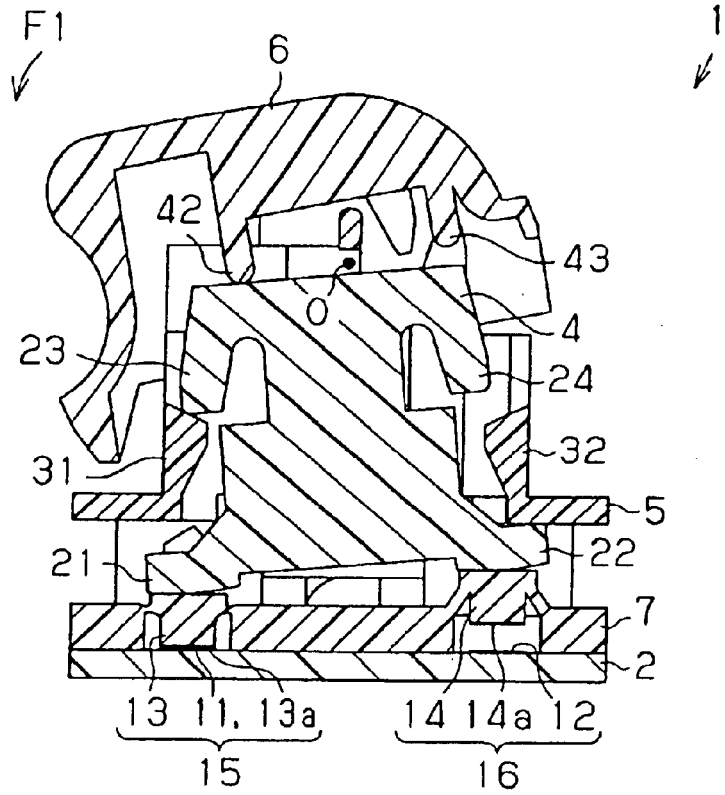
FIGS. 4A and 4B are cross-sectional views taken along line 3—3 of FIG. 2 showing the two-step switch device of FIG. 1 in different modes.
Figure 5A:
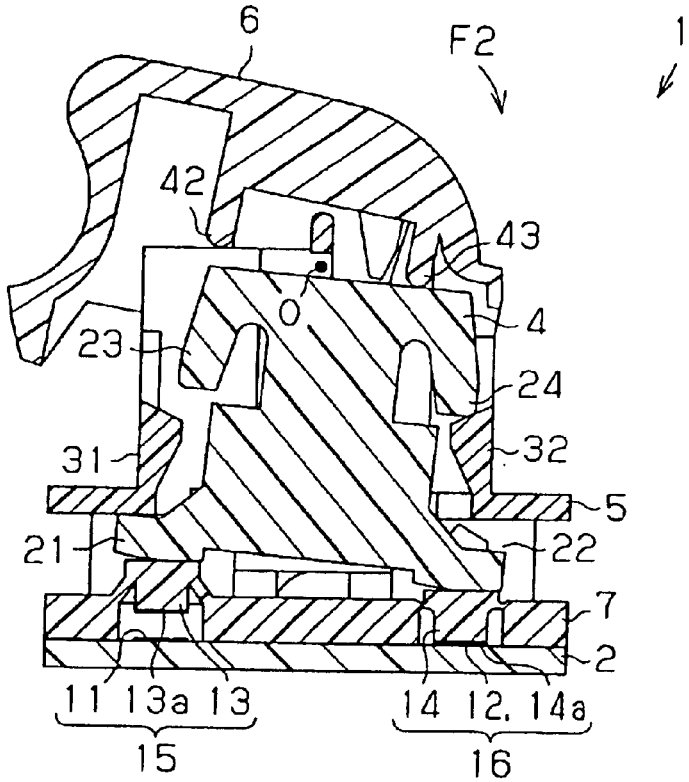
FIGS. 5A and 5B are cross-sectional views taken along line 3—3 of FIG. 2 showing the two-step switch device of FIG. 1 in different modes.

Referring to FIG. 1, slots 5*a* and 5*b* are formed in the lower end of the switch body 5 to respectively receive the projections 4*a* and 4*b* so as to enable the inclination of the pusher 4. The pusher 4 is accommodated in the switch body 5 in a state in which the projections 4*a* and 4*b* are received in the slots 5*a* and 5*b*. Referring to FIG. 2, a button support 5*c*, which supports the button 6 in an inclinable manner, is formed at the upper portion of the switch body 5 along the center line of the pusher 4. The first receiving portion 31, which supports the distal end of the first extension 23 of the pusher 4, and the second receiving portion 32, which supports the distal end of the second extension 24 of the pusher 4, are formed on the inner surface of the switch body 5. The first and second receiving portions 31 and 32 each have an upper surface, which defines a receiving surface. The receiving surface is inclined downward in the switch body 5. Referring to FIGS. 4A and 5A, when the pusher 4 is inclined, the receiving surfaces of the first and second receiving portions 31 and 32 support the associated first and second extensions 23 and 24 at a generally right angle with respect to the inclination direction of the pusher 4.

As shown in FIGS. 1 to 5B, the button 6 includes a hole (inclination axis portion) 41, a first pushing portion 42, and a second pushing portion 43. The first pushing portion 42 is located on a surface of the button 6 at a position faced towards the front portion of the pusher 4 to push the top of the pusher 4 downwards when the button 6 is inclined in the first direction. The second pushing portion 43 is located on a surface of the button 6 at a position facing towards the rear portion of the pusher 4 to push the top of the pusher 4 downwards when the button 6 is inclined in the second direction. The button support 5*c* of the switch body 5 is fitted to the hole 41 to support the button 6 in an inclinable manner. Accordingly, the button 6 is inclinable in the first direction and the second direction about an inclination axis O, which is shown in FIGS. 3 to 5B. The first pushing portion 42 pushes the front part of the top of the pusher 4. The second pushing portion 43 pushes the rear part of the top of the pusher 4. In the preferred embodiment, the first and second extensions 23 and 24 are each separated from the hole 41 by the same distance.

The operation of the above switch device 1 will now be described in detail with reference to FIGS. 4A to 5B.

[Example in Which the Button 6 is Inclined in the First Direction]

Referring to FIG. 4A, when the button 6 is inclined in the first direction (in the direction of arrow F1), the first pushing portion 42 downwardly pushes the front part of the top of the pusher 4 (the portion at the first extension 23 side of the hole 41). This inclines the pusher 4 in the first direction while elastically deforming the first dome 13 with the first switch operator 21. Subsequently, the first movable contact 13*a* contacts the first fixed contact 11 when the button 6 is inclined to a first operation position, as shown in the state of FIG. 4A. At the first operation position, the distal end of the first extension 23 of the pusher 4 abuts against the first receiving portion 31 of the switch body 5.

Figure 4B:
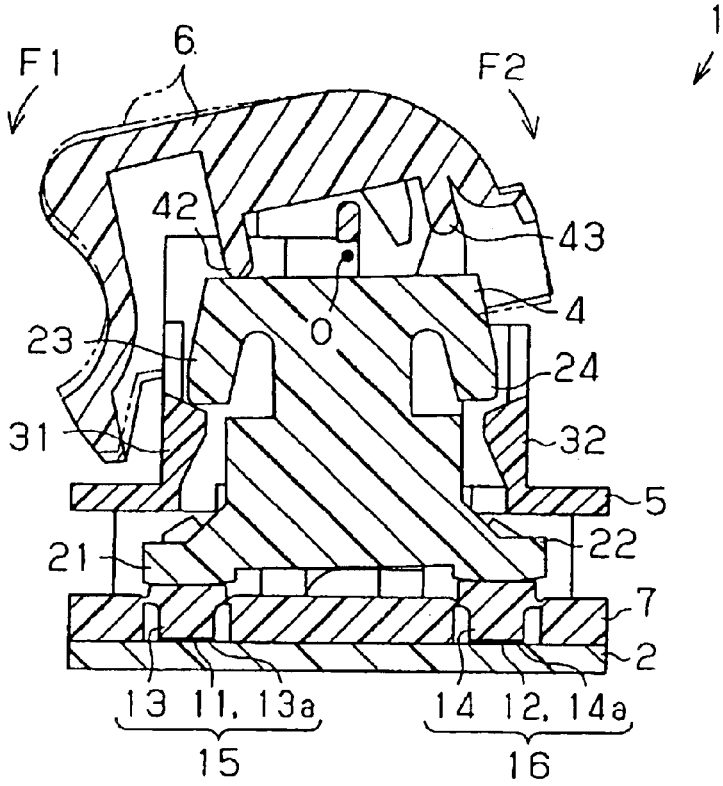

When the button 6 is further inclined in the first direction from the first operation position, the first pushing portion 42 further pushes the pusher 4 downward. In this state, the first extension 23 is in contact with the first receiving portion 31. Thus, referring to FIG. 4B, the pusher 4 inclines in the second direction (in the direction of arrow F2) about the position of contact and elastically deforms the second dome 14 with the second switch operator 22. Subsequently, the second movable contact 14*a* contacts the second fixed contact 12 when the button 6 is inclined to a second operation position, which is shown by solid lines in the state of FIG. 4B. The broken lines of FIG. 4B show the button 6 in a state located at the first operation position.

As described above, when the button 6 is inclined in the first direction to the first operation position, only the first switch 15 is activated. Further inclination of the button 6 to the second operation position activates both of the first and second switches 15 and 16. In other words, the button 6 is operated in the first direction in two steps to activate the first and second switches 15 and 16 in two modes.

[Example in Which the Button 6 is Inclined in the Second Direction]

Referring to FIG. 5A, when the button 6 is inclined in the second direction (in the direction of arrow F2), the second pushing portion 43 downwardly pushes the rear part of the top of the pusher 4 (the portion at the second extension 24 side of the hole 41). This inclines the pusher 4 in the second direction while elastically deforming the second dome 14 with the second switch operator 22. Subsequently, the second movable contact 14*a* contacts the second fixed contact 12 when the button 6 is inclined to a third operation position, as shown in the state of FIG. 5A. At the third operation position, the distal end of the second extension 24 of the pusher 4 abuts against the second receiving portion 32 of the switch body 5.

Figure 5B:
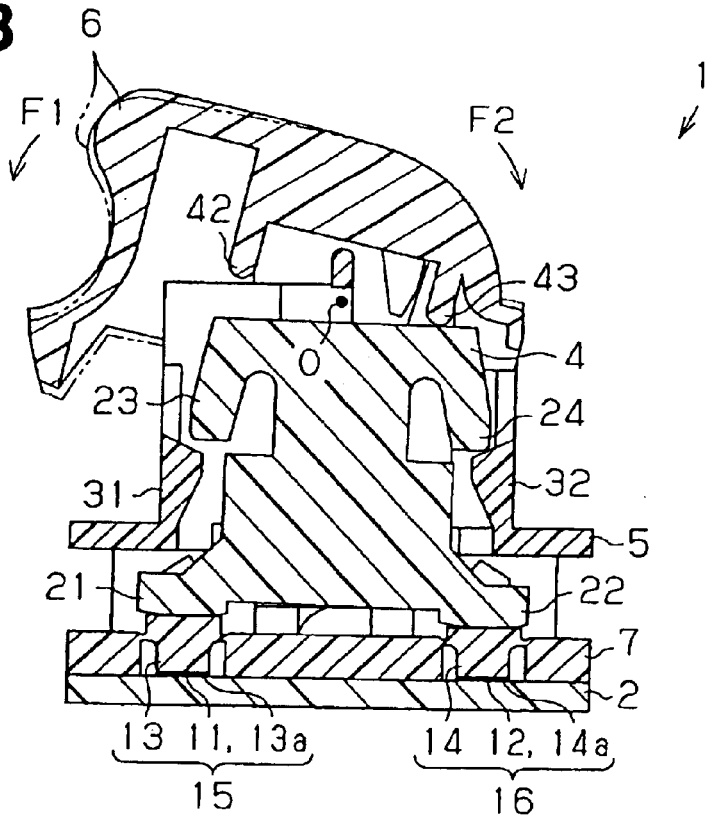

When the button 6 is further inclined in the second direction from the third operation position, the second pushing portion 43 further pushes the pusher 4 downward. In this state, the second extension 24 is in contact with the second receiving portion 32. Thus, referring to FIG. 5B, the pusher 4 inclines in the first direction (in the direction of arrow F1) about the position of contact and elastically deforms the first dome 13 with the first switch operator 21. Subsequently, the first movable contact 13*a* contacts the first fixed contact 11 when the button 6 is inclined to a fourth operation position, which is shown by solid lines in the state of FIG. 5B. The broken lines of FIG. 5B show the button 6 in a state located at the third operation position.

As described above, when the button 6 is inclined in the second direction to the third operation position, only the second switch 16 is activated. Further inclination of the button 6 to the fourth operation position activates both of the first and second switches 15 and 16. In other words, the button 6 is operated in the second direction in two steps to activate the first and second switches 15 and 16 in two modes. Accordingly, the button 6 is operated in two steps in each of the first and second directions to activate the first and second switches 15 and 16 in a total of four modes.

The structure and operation of a vehicle window driving apparatus 51 incorporating the switch device 1 will now be discussed with reference to FIGS. 6 and 7.

Figures 6, 7:
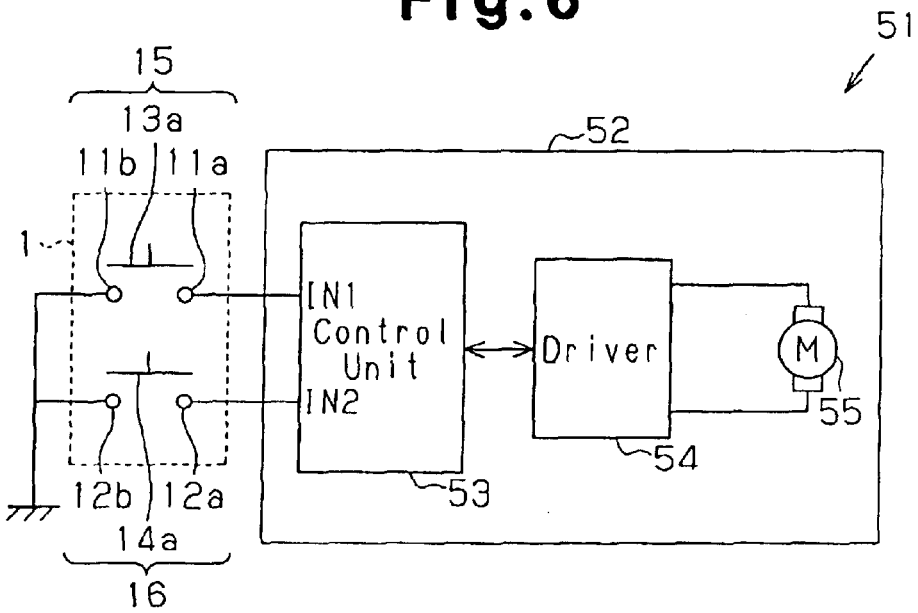
FIG. 6 is a schematic block diagram of a vehicle window drive apparatus that uses the two-step switch device of FIG. 1.
FIG. 7 is a table showing the control of a vehicle window with the two-step switch device of FIG. 1.

Referring to FIG. 6, the window driving apparatus 51 includes the switch device 1 and a window regulator system (WRS) 52. The WRS 52 includes a control unit 53, a driver 54, and a motor 55.

The control unit 53 includes a CPU, a RAM, and a ROM (not shown). The control unit 53 is electrically connected to the first and second switches 15 and 16 of the switch device 1 and to the driver 54. More specifically, the first fixed contact 11 of the switch device 1 includes a contact 11*a*, which is connected to a first input port IN1 of the control unit 53, and a contact 11*b*, which is grounded. The contacts 11*a* and 11*b* are electrically connected to each other when the first movable contact 13*a* contacts the first fixed contact 11. The second fixed contact 12 includes a contact 12*a*, which is connected to a second input port IN2 of the control unit 53, and a contact 12*b*, which is grounded. The contacts 12*a* and 12*b* are electrically connected to each other when the second movable contact 14*a* contacts the second fixed contact 12. When the first movable contact 13*a* contacts the first fixed contact 11, or when the first switch 15 is activated, the first input port IN1 is provided with a signal having a low level (first pushing operation signal). When the second movable contact 14*a* contacts the second fixed contact 12, or when the second switch 16 is activated, the second input port IN2 is provided with a signal having a low level (second pushing operation signal). When the first and second switches 15 and 16 are inactivated, the associated input ports IN1 and IN2 are each provided with a signal having a high level.

The driver 54, which is electrically connected to a motor 55, drives the motor 55 in accordance with a command signal from the control unit 53. The motor 55 is an actuator for opening and closing a vehicle window (e.g., window glass for driver's seat). The driver 54 drives the motor 55 to open the window in response to an open drive signal from the control unit 53. Further, the driver 54 drives the motor 55 to close the window in response to a close drive signal from the control unit 53.

The control unit 53 controls the opening or closing of the window based on the signal input to the first and second input ports IN1 and IN2. That is, the control unit 53 determines the activation and inactivation of the first and second switches 15 and 16 and controls the motor 55 accordingly.

More specifically, referring to FIG. 7, when only the first switch 15 is activated, the control unit 53 performs manual open drive control. During the manual open drive control, the control unit 53 provides the driver 54 with the open drive signal to open the window only when the first switch 15 is activated. That is, the window continues to move in a direction in which it opens as long as the button 6 of the switch device 1 is inclined to the first operation position.

The control unit 53 performs automatic open drive control when the second switch 16 is activated after the first switch 15 is activated. During the automatic open drive control, the control unit 53 continues to provide the driver 54 with the open drive signal until the window is completely opened (the window is moved to a lowermost position). That is, during the automatic open drive control, the control unit 53 continues to provide the driver 54 with the open drive signal even if the first and second switches 15 and 16 are inactivated. Thus, during the automatic open drive control, the window moves to the lowermost position even if the button 6 returns from the second operation position (as shown by the solid lines in the state of FIG. 4B) to its original position (as shown by the state of FIG. 3).

When only the second switch 16 is activated, the control unit 53 performs manual close drive control. During the manual close drive control, the control unit 53 provides the driver 54 with the close drive signal to close the window only when the second switch 16 is activated. That is, the window continues to move in a direction in which it closes as long as the button 6 of the switch device 1 is inclined to the third operation position.

The control unit 53 performs automatic close drive control when the first switch 15 is activated after the second switch 16 is activated. During the automatic close drive control, the control unit 53 continues to provide the driver 54 with the close drive signal until the window is completely closed (the window is moved to an uppermost position). That is, during the automatic close drive control, the control unit 53 continues to provide the driver 54 with the close drive signal even if the first and second switches 15 and 16 are inactivated. Thus, during the automatic close drive control, the window moves to the uppermost position even if the button 6 returns from the fourth operation position (as shown by the solid lines in the state of FIG. 5B) to its original position (as shown by the state of FIG. 3).

The switch device 1 of the preferred embodiment has the advantages described below.

(1) When the button 6 is inclined in the first direction (direction indicated by arrow F1 in FIGS. 3 to 5B) to the first operation position, the first switch 15 is first solely activated (first mode). Subsequently, if the button 6 is inclined in the first direction to the second operation position, the second switch 16 is activated in addition to the first switch 15 (second mode). That is, in the second mode, the second switch 16 is activated after the first switch 15 is activated. Further, when the button 6 is inclined in the second direction (direction indicated by arrow F2 in FIGS. 3 to 5) to the third operation position, the second switch 16 is first solely activated (third mode). Then, if the button 6 is inclined in the second direction to the fourth operation position, the first switch 15 is activated in addition to the second switch 16 (fourth mode). That is, in the fourth mode, the first switch 15 is activated after the second switch 16 is activated. In this manner, the activated state of the first and second switches 15 and 16 changes between four modes in accordance with the inclined amount of the button 6 in the first and second directions. In other words, the switch device 1 detects four operation modes of the button 6 with the two switches 15 and 16. Furthermore, the first pushing portion 42 pushes the top of the pusher 4 at a position near the first switch 15. In addition, the second pushing portion 43 pushes the top of the pusher 4 at a position near the second switch 16. Accordingly, the force required to incline the button 6 in the first direction to activate the first and second switches 15 and 16 is about the same as the force required to incline the button 6 in the second direction to activate the first and second switches 15 and 16.

The first switch 15 includes only the fixed and movable contacts 11 and 13*a* and the second switch 16 includes only the fixed and movable contacts 12 and 14*a* in the switch device 1. In other words, the switch device 1 of the preferred embodiment does not require four fixed contacts and four movable contacts as in the conventional switch device. Accordingly, the switch device 1 decreases the number of components while decreasing the difference between the force required to incline the button 6 in the first direction and the force required to incline the button 6 in the second direction.

(2) The button 6 is inclined in the first direction to the first operation position. This activates only the first switch 15 and abuts the first extension (contact portion) 23 of the pusher 4 against the first receiving portion 31 of the switch body 5. Subsequently, the button 6 is further inclined in the first direction from the first operation position to the second operation position. This inclines the pusher 4 in the second direction about the position of contact and activates both of the switches 15 and 16. Further, the button 6 is inclined in the second direction to the third operation position. This activates only the second switch 16 and abuts the second extension (contact portion) 24 of the pusher 4 against the second receiving portion 32 of the switch body 5. Subsequently, the button 6 is further inclined in the second direction from the third operation position to the fourth operation position. This inclines the pusher 4 in the first direction about the position of contact and activates both of the switches 15 and 16. In this manner, when the switches 15 and 16 are both activated, the extensions 23 and 24 and the receiving portions 31 and 32 prevent excessive load from being applied to the positions of contact between the fixed contacts 11 and 12 and movable contacts 13*a* and 14*a* of the switches 15 and 16 that have already been activated. This further prevents abnormal functioning of the first and second switches 15 and 16 that would be caused when excessive load is applied to the positions of contact.

(3) The control unit 53 of the WRS 52 performs manual open drive control, automatic open drive control, manual close drive control, and automatic close drive control of a window in accordance with the contact state and contact order of the fixed contacts 11 and 12 and movable contacts 13*a* and 14*a* of the first and second switches 15 and 16. Accordingly, the vehicle window is sufficiently controlled with the switch device 1, which includes only two fixed contacts 11 and 12 and two movable contacts 13*a* and 14*a*.

(4) The first and second switches 15 and 16 are operated against the elasticity of the first and second domes 13 and 14, which are formed from a resiliently deformable soft resin. The positioning feel of the button 6 is produced by the elasticity of the first and second domes 13 and 14. Thus, the operator perceives a desirable positioning feel even if the button 6 is inclined to any one of the first to fourth operation positions.

(5) The upper surfaces of the first and second receiving portions 31 and 32 formed in the switch body 5 define receiving surfaces. Each receiving surface is inclined downward in an inward direction in the switch body 5. When the pusher 4 is inclined, the receiving surfaces of the first and second receiving portions 31 and 32 support the associated first and second extensions 23 and 24 at a generally right angle with respect to the inclination direction of the pusher 4. This ensures that the first receiving portion 31 receives the force applied to the pusher 4 when the button 6 is inclined from the first operation position to the second operation position and that the second receiving portion 32 receives the force applied to the pusher 4 when the button 6 is inclined from the third operation position to the fourth operation position. Accordingly, excessive load is prevented from being applied to the positions of contact between the fixed contacts 11 and 12 and the associated movable contacts 13*a* and 14*a*.

(6) The first dome 13 and the second dome 14 have substantially the same shape and size. The load required to elastically deform the first dome 13 is about the same as the load required to elastically deform the second dome 14. The pusher 4 is symmetrical about the centerline shown in FIG. 3. The first pushing portion 42 and the second pushing portion 43 of the button 6 push the top of the pusher 4 at positions equally spaced from the centerline shown in FIG. 3. Accordingly, the force required to incline the button 6 in the first direction and elastically deform the domes 13 and 14 is substantially the same as the force required to incline the button 6 in the second direction and elastically deform the domes 13 and 14.

In other words, the loads required to elastically deform the first dome 13 and the second dome 14 do not have to differ from each other in order to substantially equalize the force required to incline the button 6 in the first and second directions.

It should be apparent to those skilled in the art that the present invention may be embodied in many other specific forms without departing from the spirit or scope of the invention. Particularly, it should be understood that the present invention may be embodied in the following forms.

In the preferred embodiment, the first and second switches 15 and 16, which are formed from a resiliently deformable soft resin, are operated against the elasticity of the first and second domes 13 and 14 arranged on the base 7. However, the first and second switches 15 and 16 do not have to have the first and second domes 13 and 14. For example, the first and second switches 15 and 16 may have the same structure as that of a push button switch, such as a typical tact switch.

In the preferred embodiment, when the button 6 is not inclined, the fixed contacts 11 and 12 do not contact the associated movable contacts 13*a* and 14*a*. After the button 6 is inclined, the fixed contacts 11 and 12 contact the associated movable contacts 13*a* and 14*a*. Conversely, the switch device 1 may be configured so that the fixed contacts 11 and 12 contact the movable contacts 13*a* and 14*a* when the button 6 is not inclined and the fixed contacts 11 and 12 do not contact the movable contacts 13*a* and 14*a* when the button 6 is inclined. In such a structure, a state in which the fixed contacts 11 and 12 contact the associated movable contacts 13*a* and 14*a* correspond to an inactivated state (OFF) of a switch in FIG. 7. Further, a state in which the fixed contacts 11 and 12 do not contact the associated movable contacts 13*a* and 14*a* correspond to an activated state (ON) of a switch in FIG. 7.

In the preferred embodiment, the first and second extensions 23 and 24 are formed on the pusher 4. However, the first and second extensions 23 and 24 do not have to be formed on the pusher 4. In such a structure, when the button 6 is inclined from the first operation position to the second operation position or when the button 6 is inclined from the third operation position to the fourth operation position, the pusher 4 may be moved about positions of contact between the domes 13 and 14 and the switch operators 21 and 22 of the activated switches 15 and 16.

In the preferred embodiment, the switch device 1 is used for a vehicle window driving apparatus 51. However, the application of the switch device 1 is not restricted to a vehicle window driving apparatus 51. The switch device 1 may be applied to other apparatuses that operate a controlled subject.

The present examples and embodiments are to be considered as illustrative and not restrictive, and the invention is not to be limited to the details given herein, but may be modified within the scope and equivalence of the appended claims.

What is claimed is:

1. A switch device operable in two steps, the switch device comprising:

a first switch;

a second switch;

a button, inclinable in a first direction for activating the first switch and a second direction for activating the second switch, the button being inclinable to a first operation position and a second operation position when inclined in the first direction and being inclinable to a third operation position and a fourth operation position when inclined in the second direction;

a pusher arranged between the button and the first and second switches, the pusher being movable when the button is pushed, the pusher comprising a first extension and a second extension; and a switch body for supporting the button in an inclinable manner and for accommodating the pusher, the switch body including a first receiving portion for contacting the first extension of the pusher when the button is inclined in the first direction and a second receiving portion for contacting the second extension of the pusher when the button is inclined in the second direction, wherein inclination of the button in the first direction to the first operation position moves the pusher to solely activate the first switch;

further inclination of the button in the first direction to the second operation position moves the pusher about a position of contact between the first extension and the first receiving portion to activate the second switch in addition to the first switch;

inclination of the button in the second direction to the third operation position moves the pusher to solely activate the second switch; and further inclination of the button in the second direction to the fourth operation position moves the pusher about a position of contact between the second extension and the second receiving portion to activate the first switch in addition to the second switch.

2. The switch device according to claim 1, wherein the pusher includes a first switch operator, facing towards the first switch, for activating the first switch, and a second switch operator, facing towards the second switch, for activating the second switch.

3. The switch device according to claim 2, wherein the first extension and the second extension are respectively arranged opposite the first and second switch operators, and wherein the button includes a first pushing portion for pushing a first portion located at a first extension side of a top of the pusher and a second pushing portion for pushing a second portion located at a second extension side of the top of the pusher.

4. A switch device operable in two steps, the switch device comprising:

a first switch including a first fixed contact and a first movable contact associated with the first fixed contact;

a second switch including a second fixed contact and a second movable contact associated with the second fixed contact;

a pusher movably arranged on the first and second movable contacts, the pusher including a first switch operator, arranged in association with the first movable contact for activating the first switch and a second switch operator, arranged in association with the second movable contact, for activating the second switch; the pusher further including a first extension and a second extension respectively arranged opposite the first and second switch operators;

a switch body for supporting the button in an inclinable manner and for accommodating the pusher, the switch body including a first receiving portion for contacting the first extension of the pusher when the button is inclined in the first direction and a second receiving portion for contacting the second extension of the pusher when the button is inclined in the second direction; and a button including a first pushing portion for pushing a first portion located at a top of the pusher in correspondence with the first switch and a second pushing portion for pushing a second portion located at the top of the pusher in correspondence with the second switch, the button being inclinable in a first direction to push the pusher with the first pushing portion and being inclinable in a second direction to push the pusher with the second pushing portion, the button being inclinable to a first operation position and a second operation position when inclined in the first direction and being inclinable to a third operation position and a fourth operation position when inclined in the second direction, wherein inclination of the button in the first direction to the first operation position moves the pusher and solely activates the first switch with the first switch operator;

further inclination of the button in the first direction to the second operation position further moves the pusher and activates the second switch with the second switch operator in addition to the first switch;

inclination of the button in the second direction to the third operation position moves the pusher and solely activates the second switch with the second switch operator; and further inclination of the button in the second direction to the fourth operation position further moves the pusher and activates the first switch with the first switch operator in addition to the second switch; and wherein the pusher is moved about a position of contact between the first extension and the first receiving portion when the button is inclined from the first operation position to the second operation position to activate the second switch, and the pusher is moved about a position of contact between the second extension and the second receiving portion when the button is inclined from the third operation position to the fourth operation position to active the first switch.

5. The switch device according to claim 4, wherein the first receiving portion includes a first receiving surface for receiving the first extension at a generally right angle, and the second receiving portion includes a second receiving surface for receiving the second extension at a generally right angle.

6. The switch device according to claim 4, wherein the load required for activating the first switch is substantially equal to the load required for activating the second switch.

7. The switch device according to claim 4, wherein the first switch includes a resiliently deformable first dome having a concave surface, and the second switch includes a resiliently deformable second dome having a convex surface, the first movable contact being arranged on the concave surface of the first dome, and the second movable contact being arranged on the concave surface of the second dome.

8. The switch device according to claim 7, wherein the first dome and the second dome have substantially the same shape and size.

9. The switch device according to claim 4, wherein the pusher has a shape that is substantially symmetrical about its centerline, and the first and second pushing portions of the button push the pusher at positions equally spaced from the centerline of the pusher.

10. A switch device operable in two steps, the switch device comprising:

a first switch;

a second switch;

a pusher movably arranged on the first and second switches, the pusher including a first switch operator, arranged in association with the first switch, for activating the first switch, a second switch operator, arranged in association with the second switch, for activating the second switch, and a first extension and a second extension respectively arranged opposite the first and second switch operators;

a switch body for accommodating the pusher, the switch body including a first receiving portion for contacting the first extension of the pusher and a second receiving portion for contacting the second extension of the pusher; and a button supported by the switch body in an inclinable manner, the button including a first pushing portion for pushing a first portion located at a top of the pusher in correspondence with the first switch and a second pushing portion for pushing a second portion located at the top of the pusher in correspondence with the second switch, the button being inclinable in a first direction to push the pusher with the first pushing portion and being inclinable in a second direction to push the pusher with the second pushing portion, the button being inclinable to a first operation position and a second operation position when inclined in the first direction and being inclinable to a third operation position and a fourth operation position when inclined in the second direction, wherein inclination of the button in the first direction to the first operation position moves the pusher and solely activates the first switch with the first switch operator;

further inclination of the button in the first direction to the second operation position further moves the pusher about a position of contact between the first extension and the first receiving portion to activate the second switch with the second switch operator in addition to the first switch;

inclination of the button in the second direction to the third operation position moves the pusher and solely activates the second switch with the second switch operator; and further inclination of the button in the second direction to the fourth operation position further moves the pusher about a position of contact between the second extension and the second receiving portion to activate the first switch with the first switch operator in addition to the second switch.

11. A vehicle window drive apparatus for opening and closing a vehicle window, the vehicle window drive apparatus comprising:

a switch device operated to open and close the vehicle window, the switch device including;

a first switch including a first fixed contact and a first movable contact associated with the first fixed contact;

a second switch including a second fixed contact and a second movable contact associated with the second fixed contact;

a pusher movably arranged on the first and second movable contacts, the pusher including a first switch operator arranged in association with the first movable contact, for activating the first switch and a second switch operator, arranged in association with the second movable contact, for activating the second switch; and a first extension and a second extension respectively arranged opposite the first and second switch operators;

a switch body for accommodating the pusher, the switch body including a first receiving portion for contacting the first extension of the pusher and a second receiving portion for contacting the second extension of the pusher; and a button including a first pushing portion for pushing a first portion located at a top of the pusher in correspondence with the first switch and a second pushing portion for pushing a second portion located at the top of the pusher in correspondence with the second switch, the button being inclinable in a first direction to push the pusher with the first pushing portion and being inclinable in a second direction to push the pusher with the second pushing portion, the button being inclinable to a first operation position and a second operation position when inclined in the first direction and being inclinable to a third operation position and a fourth operation position when inclined in the second direction, wherein inclination of the button in the first direction to the first operation position moves the pusher and solely activates the first switch with the first switch operator to keep the window moving in an opening direction as long as the first switch remains activated;

further inclination of the button in the first direction to the second operation position further moves the pusher about a position of contact between the first extension and the first receiving portion to activate the second switch with the second switch operator in addition to the first switch to completely open the window;

inclination of the button in the second direction to the third operation position moves the pusher and solely activates the second switch with the second switch operator to keep the window moving in a closing direction as long as the second switch remains activated; and further inclination of the button in the second direction to the fourth operation position further moves the pusher about a position of contact between the first extension and the second receiving portion to activate the first switch with the first switch operator in addition to the second switch to completely close the window.

* * * * *

UNITED STATES PATENT AND TRADEMARK OFFICE

CERTIFICATE OF CORRECTION

PATENT NO. : 6,914,202 B2
DATED : July 5, 2005
INVENTOR(S) : Satoshi Sugimoto et al.

It is certified that error appears in the above-identified patent and that said Letters Patent is hereby corrected as shown below:

Column 13,
Line 32, delete “active”, and insert therefor -- activate --.

Signed and Sealed this

Twenty-seventh Day of September, 2005

JON W. DUDAS
*Director of the United States Patent and Trademark Office*